US011913182B2

(12) United States Patent
Ali et al.

(10) Patent No.: US 11,913,182 B2
(45) Date of Patent: Feb. 27, 2024

(54) GUARDRAIL TERMINAL BARRIER

(71) Applicant: Ohio University, Athens, OH (US)

(72) Inventors: Muhammad Ali, Pickerington, OH (US); Sean R. Jenson, Athens, OH (US); Khairul Alam, Athens, OH (US)

(73) Assignee: Ohio University, Athens, OH (US)

( * ) Notice: Subject to any disclaimer, the term of this patent is extended or adjusted under 35 U.S.C. 154(b) by 163 days.

(21) Appl. No.: 17/409,140

(22) Filed: Aug. 23, 2021

(65) Prior Publication Data

US 2021/0388565 A1 Dec. 16, 2021

Related U.S. Application Data

(63) Continuation-in-part of application No. 15/781,500, filed as application No. PCT/US2016/065587 on Dec. 8, 2016, now Pat. No. 11,098,456.

(60) Provisional application No. 62/265,050, filed on Dec. 9, 2015.

(51) Int. Cl.
*E01F 15/14* (2006.01)

(52) U.S. Cl.
CPC ..... *E01F 15/146* (2013.01); *E01F 15/141* (2013.01); *E01F 15/143* (2013.01)

(58) Field of Classification Search
CPC ..... E01F 15/14; E01F 15/141; E01F 15/143; E01F 15/145; E01F 15/146; E01F 15/148; E01F 15/043; E01F 15/0453
See application file for complete search history.

(56) References Cited

U.S. PATENT DOCUMENTS

| | | | |
|---|---|---|---|
| 3,141,655 | A | 7/1964 | Platt |
| 3,473,836 | A | 10/1969 | Halter |
| 3,606,258 | A | 9/1971 | Fitch |
| 4,073,482 | A | 2/1978 | Seegmiller et al. |
| 4,183,504 | A | 1/1980 | Ford |
| 4,289,419 | A | 9/1981 | Young et al. |
| 4,645,375 | A | 2/1987 | Carney, III |
| 5,391,016 | A | 2/1995 | Ivey et al. |

(Continued)

FOREIGN PATENT DOCUMENTS

| | | |
|---|---|---|
| CN | 203821230 U | 9/2014 |
| DE | 29720583 | 3/1999 |

(Continued)

OTHER PUBLICATIONS

International Search Report and Written Opinion in International Patent Application No. PCT/US2022/037435, dated Apr. 1, 2023, 19 pgs.

(Continued)

*Primary Examiner* — Jonathan P Masinick
(74) *Attorney, Agent, or Firm* — Wood Herron & Evans LLP

(57) ABSTRACT

A force-absorbing barrier includes a plurality of chambers at least partially filled with fluid. The walls defining the chambers are flexible. Fluid passages in the interior walls between chambers allow fluid flow between the chambers. Alternatively, the chambers are filled with structures instead of or in addition to a fluid. The fluid flow from chamber to chamber and/or the deformation of the structures will absorb energy from the impact a motor vehicle, preventing the vehicle from impacting the terminal of a guardrail.

18 Claims, 5 Drawing Sheets

(56) References Cited

U.S. PATENT DOCUMENTS

| | | | | |
|---|---|---|---|---|
| 5,746,419 | A | 5/1998 | McFadden et al. | |
| 5,791,811 | A | 8/1998 | Yoshino | |
| 5,791,812 | A | 8/1998 | Ivey | |
| 5,823,584 | A | 10/1998 | Carney, III | |
| 5,957,616 | A | 9/1999 | Fitch | |
| 6,276,667 | B1 | 8/2001 | Arthur | |
| 6,755,453 | B2 * | 6/2004 | Kellas | B60R 19/42 293/120 |
| 6,773,201 | B2 | 8/2004 | Witcher | |
| 6,811,144 | B2 * | 11/2004 | Denman | E01F 15/146 404/6 |
| 6,905,281 | B2 | 6/2005 | Kang | |
| 7,478,796 | B2 | 1/2009 | Burkett | |
| 7,575,391 | B2 | 8/2009 | Asuncion | |
| 8,215,864 | B2 * | 7/2012 | Kennedy, Jr. | E01F 15/146 404/6 |
| 8,282,309 | B2 * | 10/2012 | Mettler | E01F 15/146 404/9 |
| RE43,927 | E * | 1/2013 | Buehler | E01F 15/146 404/6 |
| 8,894,318 | B2 * | 11/2014 | Sayre | C08G 18/3215 528/65 |
| 8,974,142 | B2 | 3/2015 | Buehler et al. | |
| 9,573,700 | B2 * | 2/2017 | Galbus | B64F 1/02 |
| 11,603,142 | B2 * | 3/2023 | Milne | B62D 29/043 |
| 2004/0114996 | A1 | 6/2004 | Cicinnati | |
| 2006/0013651 | A1 | 1/2006 | Williams et al. | |

FOREIGN PATENT DOCUMENTS

| | | | | |
|---|---|---|---|---|
| EP | 0157500 | | 10/1985 | |
| EP | 3795751 | B1 * | 10/2021 | E01F 15/141 |
| KR | 20030086152 | A | 11/2003 | |
| WO | 9615324 | | 5/1996 | |
| WO | 2017100433 | | 6/2017 | |

OTHER PUBLICATIONS

International Search Report in International Patent Application No. PCT/US2016/065587, dated Feb. 23, 2017, 3 pgs.

Written Opinion in International Patent Application No. PCT/US2016/065587, dated Feb. 23, 2017, 6 pgs.

* cited by examiner

GUARDRAIL TERMINAL BARRIER

CROSS-REFERENCE TO RELATED APPLICATIONS

This application is a continuation-in-part of U.S. patent application Ser. No. 15/781,500, filed on Jun. 5, 2018 (and published as U.S. Patent Publication No. 2018/0266062 A1 on Sep. 20, 2018), which is a U.S. national phase filing of International Patent Application No. PCT/US2016/065587, filed on Dec. 8, 2016 (and published as International Publication No. WO 2017/100433 A1 on Jun. 15, 2017), which claims the benefit of U.S. Patent Application Ser. No. 62/265,050, filed on Dec. 9, 2015, the disclosures of all of which are incorporated by reference herein in their entireties.

BACKGROUND OF THE INVENTION

Automobile accidents are a common occurrence in daily driving activities. According to the National Highway Traffic Safety Administration (NHTSA), over 33,000 vehicle related fatalities were reported in 2012. With millions of vehicles on the road in the U.S. at any given time, improving transportation safety is always needed. Specific attention is needed in roadside guardrail barrier design. Over fifty percent of the fatalities reported in 2012 involved crashes where the vehicle left the roadway surface. Guardrails are designed to prevent vehicles from leaving the road surface and entering potentially dangerous off-road environments. Vehicles involved in side impact of guardrails are commonly redirected back onto the roadway. This often results in minimal injuries to drivers and other occupants. Studies on side collisions with guardrails have been conducted and include flared embankments, support post spacing, and guardrail position angle. In some cases, the collision occurs with the terminal, or end, of the guard rail. These collisions are severe and often result in fatalities. Over 1,000 fatalities were due to this type of collision.

Many guardrail end terminals have been used since guardrails became common roadside additions. The standard blunt end terminal was the most widely used early technology. This terminal provided little impact absorbing qualities and has been replaced in most areas by new designs.

The buried transition terminal eliminated the blunt end of the guardrail. However, its ramp-like structure proves to be as dangerous as the blunt end type. Collisions with these barrier terminals have the potential to deflect the vehicle back into traffic. In worse situations the vehicle can become airborne and leave the roadway altogether.

The third type, ET-2000, is the most common terminal end used today. It is designed to absorb impact energy by allowing the vehicle to follow the guardrail path and shear wooden support posts. The working mechanism of the terminal redirects the guardrail away from the vehicle as the impact occurs. This method works to an extent, but its efficiency is questionable for high speed/energy collisions, in which the mechanism can fail to work properly causing the deflector to jam and the guardrail to penetrate the vehicle.

Other previously proposed end treatments are the TWINY European end treatment, box-beam bursting end treatment, and kinking guardrail treatment. All of these terminals are designed to peel away the guardrail during impact similar to the ET-2000 end treatment described earlier. Although these designs show promising energy absorbing capacity, the potential exists for the mechanism to jam and penetrate the vehicle. This event is highly dangerous and often leads to severe injury or fatality.

SUMMARY OF THE INVENTION

The focus of the present invention is to provide a safer and more efficient solution to roadside guardrail terminal ends. To that end, the present invention provides a fluid-filled and/or structure-filled barrier as a guardrail terminal or positioned forward of an existing guardrail terminal.

Transport of fluid across boundaries leads to higher energy absorption. The level of incompressibility and viscous effects of the fluid requires a significant amount of energy to move the fluid across membranes or through orifices. In addition to moving fluid across a boundary, the sloshing effect of the fluid within the container has potential to increase the energy absorbing efficiency of the structure. Similar energy absorption principles apply to the internal structures that can alternatively be used to fill a barrier (e.g., in place of or in addition to a fluid). Applying these mechanics concepts to a barrier design allows fluid to flow between the chambers of the barrel or for internal structures to deform to increase energy absorption of the structure during impact.

A multi-chambered fluid filled container with fluid passages between the chambers allows for fluid transport which, in turn, absorbs impact energy. The chambers are, in one embodiment, concentric and thereby provide a fluid flow path from the outermost chamber sequentially to the inner chambers. Further, the chambers may alternatively be filled with internal structures instead of (or in addition to) fluid while still absorbing impact energy.

The invention will be further appreciated in light of the following detailed description and drawings in which:

DETAILED DESCRIPTION OF THE INVENTION

Figure 2:
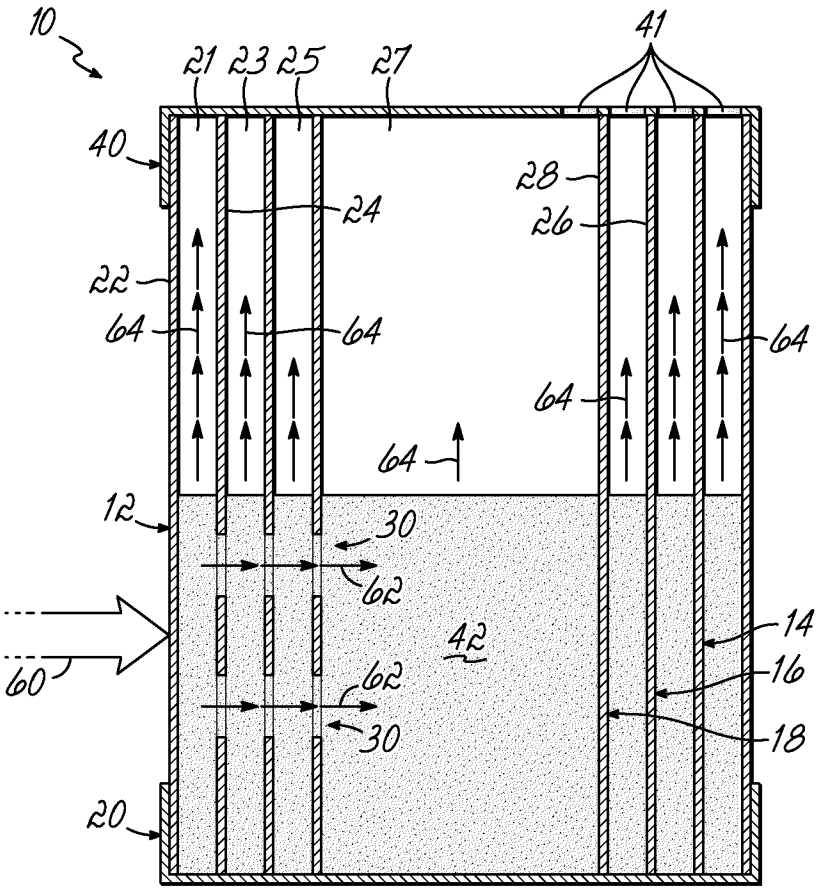
FIG. 2 is a cross-sectional view taken at lines 2-2 of FIG. 1.
Figure 1:
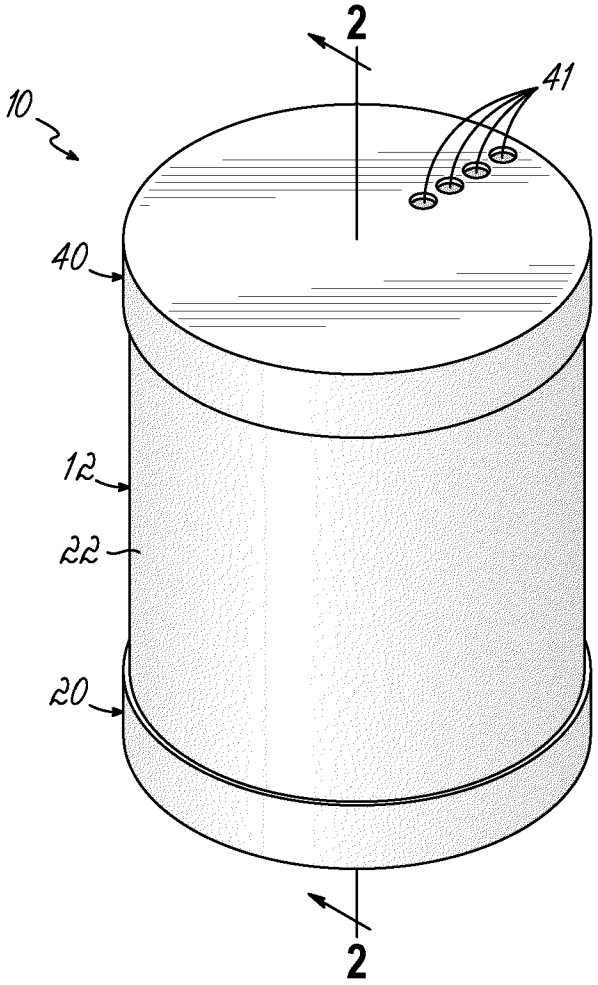
FIG. 1 is a perspective view of a barrier.
Figure 3:
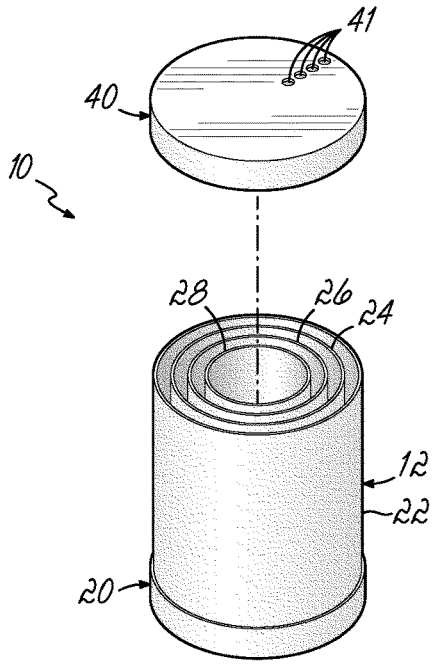
FIG. 3 is a perspective view of the barrier, similar to FIG. 1, with the top removed.
Figure 4:
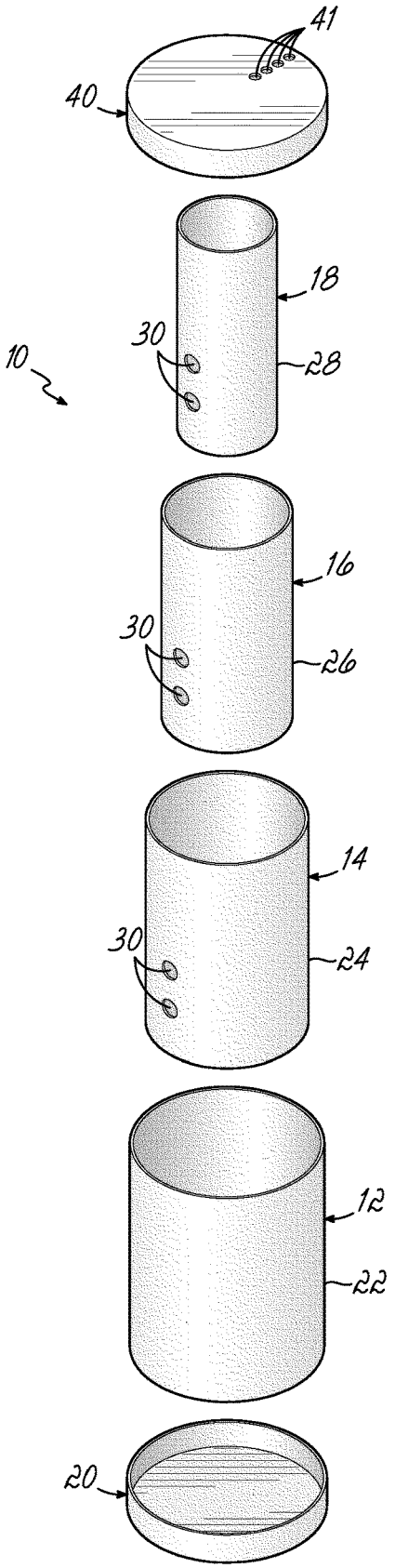
FIG. 4 is an exploded view of the barrier.

As shown in FIGS. 1-4, an embodiment of a barrier 10 designed to absorb the impact of an automobile or other motor vehicle 56 includes a plurality of concentric containers. As shown in FIGS. 1-4, there is a first container 12, a second container 14, a third container 16, and a fourth container 18. All of these containers include a common base 20 and are formed from first exterior wall 22, second wall 24, third wall 26, and fourth wall 28. Although these can be distinct and separate containers, as shown, the four walls which form the containers all share a common base 20 to which they are welded to form the containers. These walls define chambers 21, 23, 25, and 27.

The second, third, and fourth containers each include a plurality of holes or fluid passages 30 which allow fluid 42 to pass back and forth between the respective chambers. Finally, the barrier 10 includes a top 40 which is secured to the first exterior wall 22 of the first container 12. The top 40 can be secured to the wall 22 by a variety of different mechanisms. It can be snap-fitted, penetrating fasteners can be employed, or the top 40 can be welded to the first wall 22. Air passages 41 allow for compression of the barrier 10. The air passages can be holes 41 through the top 40, as shown, or a clearance between the top 40 and first exterior wall 22.

Fluid 42 is located within chambers 21, 23, 25, and 27. As shown, fluid 42 fills approximately half of the total internal area of barrier 10. The amount of fluid located within the barrier 10 can be varied to maximize impact absorption. The fluid content can be as low as 20% of the interior, up to about 100% of the interior of barrier 10. Generally, it will fill 25% to 50% of this internal area.

The fluid 42 can be any fluid which can resist environmental conditions, will not easily evaporate, and further is not a fire hazard. For example, the fluid 42 can be water in combination with antifreeze or can be other liquids, such as glycols, oils, and the like. An increased viscosity will increase the energy absorption of the barrier 10. Therefore, the fluid 42 can be a combination of chemicals which are designed to provide a fluid more viscous than water. A rainwater collector (not shown) can be used to direct water to the barrier 10.

The barrier 10 can be formed from any material that will flex upon impact and not break during impact. It can, for example, be high molecular weight polyethylene or other polymers. Further, it can be a flexible metal such as aluminum metal alloy or the like.

The size of the barrier 10 can be varied. The approximate minimum diameter is approximately 1 foot up to about 3 feet. Further, the height of the barrier 10 should be the least about 2 feet and preferably 3 feet to 5 feet or more.

As shown, the barrier 10 is a cylinder, however, it can be different shapes, depending upon the desired placement of the barrier 10. For example, it could have an octagonal, hexagonal, triangular, or even rectangular in horizontal cross-section.

The holes 30 in walls 24, 26, and 28 are designed to allow controlled fluid flow from chamber 21 into chamber 23 and from chamber 23 to chamber 25 and subsequently to chamber 27. The diameter of these holes 30 will vary depending on the size of barrier 10 as will the viscosity of the fluid 42 and the number of holes 30 per wall. Although the upper and lower limits may vary significantly, it is generally contemplated that the holes 30 will be 0.25 to 2 inches in diameter.

As shown, the holes 30 are in the lower portion of the barrier 10, in the fluid containing portion. Additional holes 30 above the fluid level may also be provided if desired. A greater total area of the holes 30 reduces the resistance to fluid flow, reducing peak force.

Figure 5:
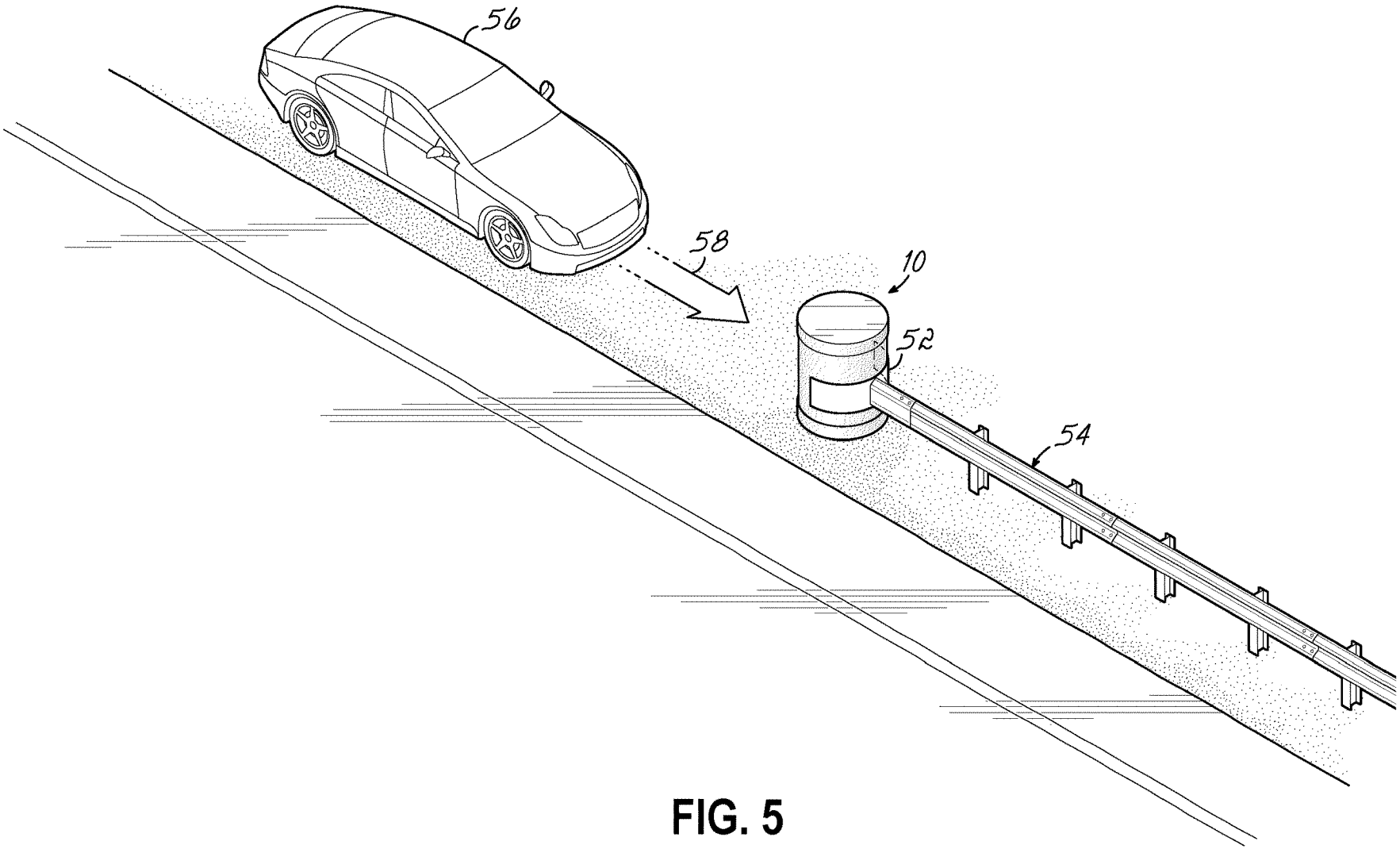
FIG. 5 is a perspective view of the barrier in its intended environment.
Figure 8:
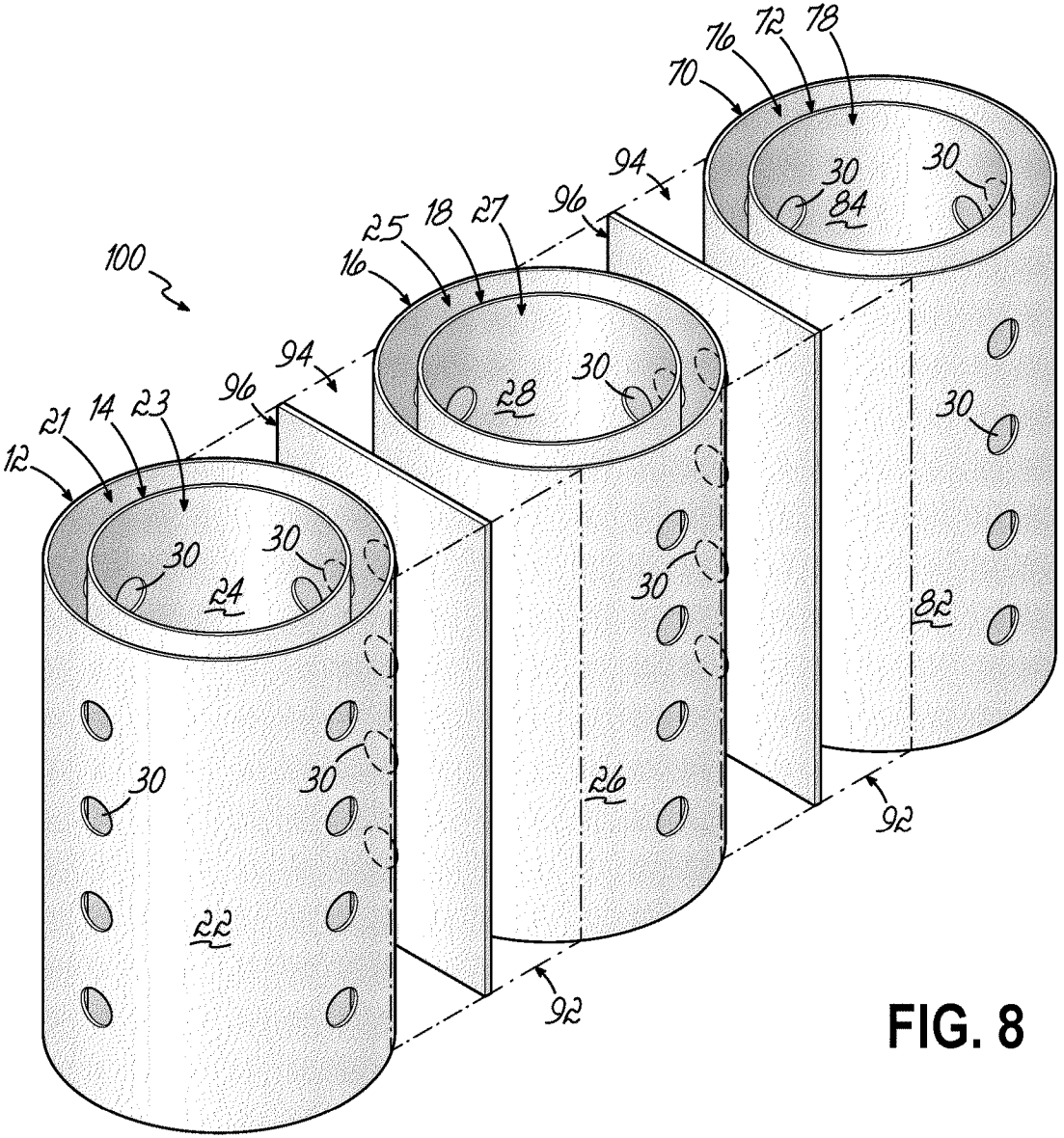
FIG. 8 is a perspective view of a barrier system including several barriers.

The barriers 10 of the present invention will typically be placed in positions to prevent automobiles 56 and the like from being severely damaged upon impact of a structure. These can be, for example, in front of the piers of a bridge or, as shown in FIG. 5, in front of an end of a guardrail 54. As shown in FIG. 5, one barrier 10 is employed. This barrier 10 is placed next to a curved plate 52 attached to guardrail 54. More barriers 10 could be employed if desired. For example. a barrier system 100, as depicted in FIG. 8, could be employed in place of or in addition to a standalone barrier 10.

FIG. 2 and FIG. 5 demonstrate the manner in which the barriers 10 (and/or barrier system 100) of the present invention will absorb energy upon impact. As a car 56 approaches the barrier 10 in the direction of arrow 58 and strikes the barrier 10, the energy represented by arrow 60 (see FIG. 2) will force initially the first wall 22 and subsequently the second 24, third 26, and fourth walls 28 inwardly. This will act to compact the fluid 42 within the barrier 10, forcing the fluid in area 21 into area 23 and then into area 25 and subsequently area 27, as shown by arrows 62. Also, the fluid in the chambers will rise as shown by arrows 64. This requires energy to move the fluid 42. All of this fluid movement absorbs the energy of the collision, slowing the vehicle 56 down and keeping the vehicle 56 from reaching the guardrail 54. As will be demonstrated in a later example, utilizing multiple compartments of liquid 42 with fluid passages 30 between the compartments absorbs more energy than a single container without any internal chambers or the like.

Figure 7:
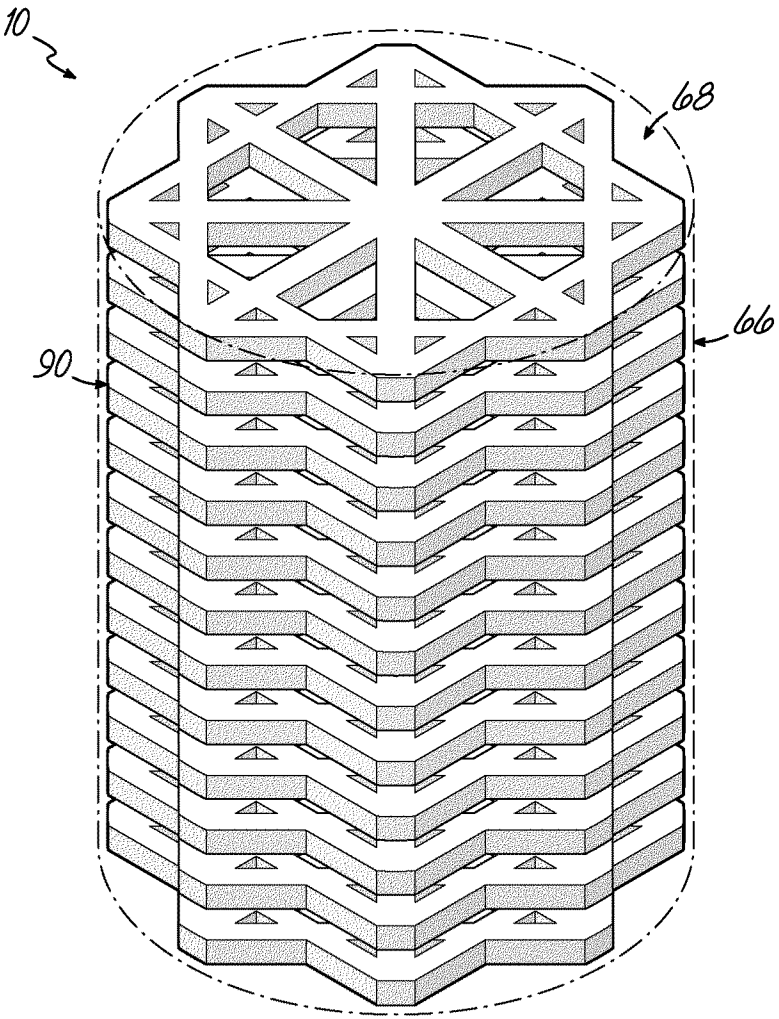
FIG. 7 is a perspective view of a further alternative embodiment of the barrier.
Figure 6:
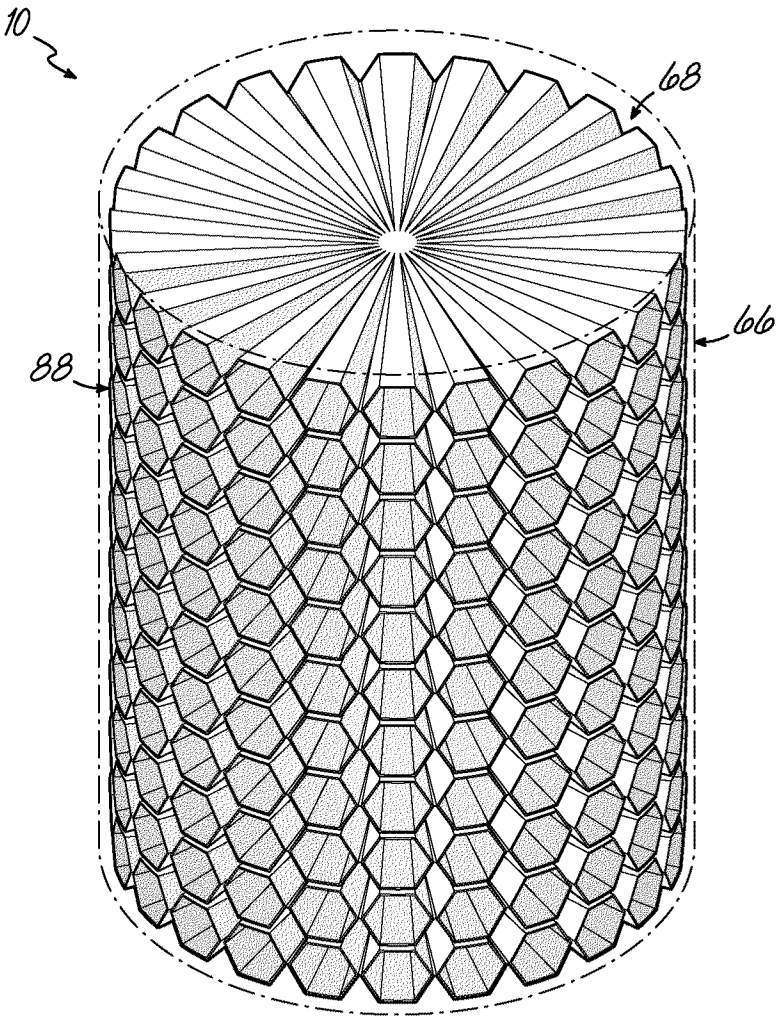
FIG. 6 is a perspective view of an alternative embodiment of the barrier.

FIGS. 6 and 7 show alternative embodiments of a barrier 10 designed to absorb the impact of an automobile or other motor vehicle 56. In the depicted embodiments, the barriers 10 includes internal structures 88, 90 to fill the void within the barrier 10 in place of (or in addition to) a fluid 42. In FIG. 6, the internal structures are honeycomb structures 88. These honeycomb structures 88 may be hexagonal in shape; however, it is to be understood that the shape of the honeycomb structures 88 may vary. In FIG. 7, the internal structures are truss structures 90. These internal structures 88, 90 provide increased strength and stability to the structure and can be used to manipulate the behavior of the barrier 10 under transverse impact loading, e.g., vehicle 56 impact. These structures 88, 90 also increase the strength to weight ratio of the barrier 10 due to the low structural density and mass of the structures 88, 90.

Though not expressly depicted in FIGS. 6 and 7, it is to be understood that the barriers 10 pictured in FIGS. 6 and 7 each have a top 40 and air passages 41, as described above with reference to FIG. 1. Further, the containers in the barriers 10 as shown in FIGS. 6 and 7 could further include concentric containers, e.g., as described above with reference to FIG. 1.

The barrier 10 can be formed from any material that will flex upon impact and not break during impact. It can, for example, be high molecular weight polyethylene or other polymers. Further, it can be a flexible metal such as aluminum metal alloy or the like. The size of the barrier 10 can be varied. The approximate minimum diameter is approximately 1 foot up to about 3 feet. Further, the height of the barrier 10 should be the least about 2 feet and preferably 3 feet to 5 feet or more. As shown, the barrier 10 is a cylinder; however, it can be different shapes, depending upon the desired placement of the barrier 10. For example, it could have an octagonal, hexagonal, triangular, or even rectangular in horizontal cross-section.

FIG. 8 shows an embodiment of a barrier system 100 designed to absorb the impact of an automobile or other motor vehicle 56. The barrier system 100 could be positioned forward of a guardrail 54 or pier or, alternatively, utilized as a roadside crash cushion device. In the depicted embodiment, the barrier system 100 includes bridging walls 92. The bridging walls 92 connect the barriers 10 to each other. The number of barriers 10 in a barrier system 100 connected by bridging walls 92 could vary. For example, FIG. 8 shows three barriers 10 within the barrier system 100 connected by bridging walls 92. However, the barrier system 100 could include additional or fewer barriers 10 connected by bridging walls 92 depending on a user's need and the particular use case.

The barriers 10 of the barrier system 100 may be one of the barrier 10 embodiments described above in reference to FIG. 1, 6, or 7, for example. Alternatively, the barrier 10 may be barrier 10 not described herein. Depending on the particular use case, a user could mix and match barrier 10 types in order to achieve a desirable end result—a particular amount of stopping force, for example. The barriers 10 shown in the barrier system 100 in FIG. 8 are similar to those depicted in FIG. 1. Particularly, the barriers 10, respectively, include a plurality of cylindrical containers 12, 14, 16, 18, 70, 72. It is to be understood that the shape of the containers may not be cylindrical. This internal arrangement of the barriers 10 within the barrier system 100 offers an increase in lateral structural support while also providing an increase in the number of fluid passages 30 present in the internal structure of the barrier 10.

As illustrated in FIG. 8, the depicted embodiment of the barriers 10 within the barrier system 100 includes a first container 12, a second container 14, a third container 16, a fourth container 18, a fifth container 70, and a sixth container 72. Some of these containers may include a common base 20. For instance, the first container 12 and the second container 14 may share a common base 20. Further, the containers are, respectively, formed from walls. For example, the first container 12 is formed by the first wall 22, the second container 14 is formed by the second wall 24, and so on. Although these can be distinct and separate containers, as shown, some of the walls which form the containers may share a common base 20 to which they can be welded to form the barrier 10. For example, the first wall 22 and the second wall 24 may share a common base 20. The walls form the respective chambers of the containers. For example, the first wall 22 of the first container 12 forms a chamber 21 within the interior of the first container 12. Similarly, the second wall 24 of the second container 14 forms a chamber 23 within the interior of the second container 14, and so on.

At least one of the containers includes at least one fluid passage 30 which allows fluid 42 to pass back and forth from the interior of the container (e.g., chamber) to the exterior of the chamber. For example, the first container 12 includes at least one fluid passage 30 to allow fluid to pass into and out of the chamber 21. More particularly, first container 12 is shown in FIG. 8 as including a plurality of fluid passages 30 arranged in an array around an exterior of the first container 12. Alternatively, the fluid passages 30 could be located on a lower portion of the containers, e.g., the potion of the container that would contain fluid 42. Additional or fewer fluid passages 30 could be provided if desired. A greater total area of the fluid passages 30 reduces the resistance to fluid flow, thus reducing peak force. This arrangement absorbs a large amount of energy, and the increased number of fluid passages 30 offers more opportunities for energy absorption.

Still referring to FIG. 8, fluid 42 is located within chambers 21, 23, 25, 27, 76, and 78. It is to be understood that fluid 42 may fill approximately half of the total internal area of barrier 10, including the area between the exterior of connected barriers 10. The amount of fluid located within the barrier system 100 can be varied to maximize impact absorption. The fluid content can be as low as 20% of the interior volume, up to about 100% of the interior volume of barrier system 100. Generally, the fluid will fill 25% to 50% of this internal area.

The fluid 42 can be any fluid which can resist environmental conditions, will not easily evaporate and further is not a fire hazard. For example, the fluid 42 can be water in combination with antifreeze or can be other liquids, such as glycols, oils, and the like. An increased viscosity will increase the energy absorption of the barrier system 100. Therefore, the fluid 42 can be a combination of chemicals which are designed to provide a fluid more viscous than water. A rainwater collector (not shown) can be used to direct water to the barrier.

The fluid passages 30 in walls 22, 24, 26, 28, 82, and 84 are designed to allow controlled fluid 42 flow between the chambers 21, 23, 25, 27, 76, and 78 and the area between connected barriers 10. The diameter of these fluid passages 30 will vary depending on the size of barrier 10 as will the viscosity of the fluid 42 and the number of fluid passages 30 per wall. Although the upper and lower limits may vary significantly, it is generally contemplated that the fluid passages 30 will be 0.25 to 2 inches in diameter.

The bridging walls 92 connect neighboring barriers 10 to each other to form a barrier system 100. Barriers 10 connected by bridging walls 92 may be arranged linearly. Alternatively, the barriers 10 connected by bridging walls 92 could be arranged in a polygonal formation. Other arrangements are also contemplated. In other words, the barrier system 100—where barriers 10 are connected by bridging walls 92—allows for a modular arrangement of barriers 10 to form a barrier system 100.

In connecting barriers 10 together, the bridging walls 92 create a bridging chamber 94 between adjacent barriers 10. Like the barriers 10, the bridging chambers 94 may be filled with a fluid 42. Alternatively, the bridging chambers 94 may not be filled with a fluid 42 and may only become filled or partially filled with a fluid 42 upon receiving a fluid 42 from a barrier 10. Further, the bridging chambers 94 feature one or more baffles 96 located within in the bridging chamber 94. For example, the baffle 96 may divide the bridging chamber 94 into two sections, as depicted in FIG. 8. One or more baffles 96 may be employed in a bridging chamber 94. Each baffle 96 features one or more fluid passages 30 that allow a fluid 42 (e.g., from a barrier 10) to pass from one side of the baffle 96 to the other. For example, the fluid passages 30 in the baffles 96 allow for fluid 42 transport between barriers 10 and between bridging chambers 94 as the barrier system 100 is crushed. The fluid passage of the baffle 96 may be substantially aligned with the fluid passages 30 of the neighboring barriers 10 within the barrier system 100. For example, the fluid passages 30 of neighboring barriers 10 and the baffle 96 may be concentrically aligned to facilitate the fluid 42 moving (e.g., during impact from a vehicle 56) from one barrier 10 through the baffle 96 and into another barrier 10. An alternate embodiment might not include fluid passages in the baffle; in such embodiments, space may be provided at top and/or bottom, or one or both sides to allow passage of fluid around baffle.

The barrier system 100, with more than one barrier 10 located therein, allows for additional barrier system 100 capacity and an ability to absorb more energy, e.g., from vehicle 56 impacts, before exhaustion of the barrier system 100. In other words, use of a barrier system 100, including multiple barriers 10 therein, can provide some advantages over deployment of a single barrier 10.

Example

The following experiment demonstrated the efficiency of the present invention. A horizontal impact tester accelerates a 4.4 kg sled up to 3 m/s providing impact energy up to 20 J. The apparatus was outfitted with an accelerometer to measure the acceleration pulse during the impact and high-speed camera to measure the displacement and velocity of the ram.

Test samples were constructed using 32 oz. plastic jars as the primary structure (4 in. diameter, 6.5 in. height) and smaller 8 oz. containers for the internal structures (2.25 in. diameter, 4.5 in. height). Orifices were placed on the internal structures to allow for fluid transport between the chambers. The placement of the orifices on the internal structures is shown. Testing criteria for the samples included: primary structure, primary structure with interior structure (no orifices), primary structure with interior structure (one orifice), primary structure with interior structure (two orifices), and primary structure with interior structure (three orifices). Each of these five configurations was tested with fluid levels of empty, quarter-filled, half-filled, three quarter-filled, and filled. A single hole was drilled on top cap in all samples to allow liquid to move.

The filled sample without an interior bottle prevented the movement of interior fluid because the fluid does not have any space to travel. This results in a large initial spike in reaction forces experience by the ram. The quarter-filled sample with two orifices on the interior bottle had adequate void space for the fluid to travel, hence allowing momentum to be transferred to the fluid and redirected throughout the structure. The initial impact causes the fluid to flow upwards along the front side of the sample. This thin film of fluid not only accepts the energy transfer but momentarily provides additional stiffness to the structure, which assists in additional energy absorption. Further momentum transfer to the fluid can be seen as the thin wall of fluid breaks and flows around the interior structure as well as through orifices. The void space of the quarter-filled sample allows for a more efficient energy transfer to the fluid and throughout the structure via exterior and interior bottle crush, movement of the water between the bottles, and forced flow of water through orifices, resulting in approximately 50% of the peak reaction force of the filled sample while giving up an additional 50% displacement.

A quarter-filled barrier allows for greater fluid movement than the filled sample. This allows for more energy transfer from the impact ram to the fluid and is then redirected away from the impact direction. This results in lower peak forces while maintaining the ability to absorb the entire impact energy. Table 1 shows the results of the two samples in comparison.

TABLE 1

Results of filled sample without interior bottle and quarter-filled sample with two orifices:

| Fluid Level | Interior Bottle | Orifices | Max Displacement cm | Peak Force N | Efficiency J/kN | Capacity J/cm |
|---|---|---|---|---|---|---|
| Filled | NO | N/A | 2.5 | 1605.8 | 7.03 | 4.52 |
| ¼ Filled | 62YES | 2 | 3.7 | 861.2 | 14.22 | 3.29 |

Upon completion of testing, two parameters were developed to describe the behavior of the sample during impact. The first was efficiency, energy absorbed per unit force (kN) imparted on the impact ram. The second parameter, capacity, is energy absorbed per unit displacement (cm). The empty samples had the lowest average peak forces but resulted in the lowest capacities. The filled samples had the highest capacity but also imparted the highest peak forces. The sample configuration that performed best was the sample with two orifices and quarter-filled with water. This sample had an efficiency of 14.22 J absorbed per kN of reactive force. This resulted in an efficiency increase that is more than double as compared to the filled sample without interior bottle. Its capacity was near average at 3.29 J absorbed per cm of displacement.

Tests were performed on a bottle with an interior bottle (one orifice) for fluid levels of quarter-filled, half-filled and three-quarter-filled. For this group of samples and the remaining samples, the empty and filled samples were not included in analysis. This was due to the empty samples having the lowest capacity and the filled samples having the highest peak forces and lowest efficiency. The results for energy absorbed, peak force, maximum displacement, efficiency and capacity are shown below in Table 2.

TABLE 2

Energy and peak force results for the bottle with interior bottle (one orifice). (E/F is energy absorbed/unit force. Units are J/kN. E/D is energy absorbed/unit displacement. Units are J/cm.)
Interior Bottle (1 orifice)

| | Total Energy (J) | Peak Force (N) | Max Displacement (cm) | E/F | E/D |
|---|---|---|---|---|---|
| ¼ filled | 10.5438 | 1012.5588 | 3.33 | 10.4130 | 3.1711 |
| ½ filled | 10.6694 | 1038.3400 | 3.30 | 10.2754 | 3.2332 |
| ¾ filled | 12.8402 | 1196.8572 | 3.17 | 10.7283 | 4.0569 |

The results in Table 2 above show that the three-quarter-filled sample has the highest efficiency, E/F value of 10.7283 J/kN. This sample also has the highest capacity, E/D value of 4.0569 J/cm. The three-quarter-filled sample does have the highest peak force (1196.8572 N) of the group, but its highest efficiency and capacity values make this sample the best selection of the group.

Tests were performed on the bottle with an interior bottle (two orifices) for fluid levels of quarter-filled, half-filled and three-quarter-filled. Again, the empty and filled samples were excluded from analysis because of their low efficiency and capacity potential. The results for energy absorbed, peak force, maximum displacement, efficiency and capacity are shown below in Table 3.

TABLE 3

Energy and peak force results for the bottle with interior bottle (2 orifices). (E/F is energy absorbed/unit force. Units are J/kN. E/D is energy absorbed/unit displacement. Units are J/cm.)
Interior Bottle (2 orifices)

| | Total Energy (J) | Peak Force (N) | Max Displacement (cm) | E/F | E/D |
|---|---|---|---|---|---|
| ¼ filled | 12.2454 | 861.1988 | 3.72 | 14.2191 | 3.2918 |
| ½ filled | 11.9422 | 1073.7276 | 3.42 | 11.1222 | 3.4970 |
| ¾ filled | 11.9986 | 1053.4392 | 2.93 | 11.3899 | 4.0951 |

The sample with the highest efficiency is the quarter-filled sample with an E/F value of 14.2191 J/kN. This samples has the lowest peak force of 861.1988 N. The three-quarter-filled sample has the highest capacity, E/D value of 4.0951 J/cm. This sample has the second highest peak force of 1053.4392 N. The quarter-filled sample is the best choice of the group since its efficiency is highest and has a capacity of 3.2918 J/cm.

Lastly, tests were performed on the bottle with an interior bottle (3 orifices) for fluid levels of quarter-filled, half-filled and three-quarter-filled. The empty and filled samples were excluded from analysis because of their low efficiency and capacity potential. The results for energy absorbed, peak force, maximum displacement, efficiency and capacity are shown below in Table 4.

TABLE 4

Energy and peak force results for the bottle with interior bottle (3 orifices). (E/F is energy absorbed/unit force. Units are J/kN. E/D is energy absorbed/unit displacement. Units are J/cm.)
Interior Bottle (3 orifices)

| | Total Energy (J) | Peak Force (N) | Max Displacement (cm) | E/F | E/D |
|---|---|---|---|---|---|
| ¼ filled | 11.5698 | 1018.2128 | 3.50 | 11.3629 | 3.3047 |
| ½ filled | 10.7892 | 1106.3756 | 3.28 | 9.7518 | 3.2894 |
| ¾ filled | 10.8540 | 1048.0360 | 3.12 | 10.3565 | 3.4844 |

The above results show that the quarter-filled sample has the highest efficiency, E/F value of 11.3629 J/kN. This sample also has the lowest peak force imparted on the ram of 1018.2128 N. The three-quarter-filled sample has the highest capacity, E/D value of 3.4844 J/cm. This sample does show a slight increase in peak force at 1048.0360 N. The quarter-filled sample is the best choice of this group because it has the highest efficiency and lowest peak force. Its capacity is also second highest at 3.3047 J/cm.

The above demonstrates that a multi-chamber fluid containing barrier with fluid passages between the chamber walls efficiently absorbs impact energy. This provides a safety barrier for guardrails and other highway structures.

This has been a description of the present invention, but the invention should be defined by the following claims in which:

What is claimed is:

1. An impact absorbing barrier system, comprising:

a plurality of impact absorbing barriers;

a plurality of bridging walls connecting adjacent impact absorbing barriers of the plurality of impact absorbing barriers to each other, the bridging walls forming bridging chambers between connected impact absorbing barriers; and at least one baffle in the bridging chambers between the impact absorbing barriers and the bridging walls, the baffle connected to the bridging walls, wherein the baffle includes at least one fluid passage, the fluid passage permitting fluid flow through the baffle, wherein compression of the barrier system forces a fluid through the fluid passage, thereby absorbing energy.

2. The impact absorbing barrier system of claim 1, wherein the barrier system is configured to be positioned on a highway forward of a guardrail or pier.

3. The impact absorbing barrier system of claim 2, wherein the barrier system is configured to rest against a curved plate fixed to the guardrail or the pier.

4. The impact absorbing barrier system of claim 1, wherein a barrier of the plurality of impact absorbing barriers comprises:

a plurality of containers;

each container of the plurality of containers including a wall defining a chamber within the container; and a fluid in the chamber, the wall of the container including at least one fluid passage, the fluid passage permitting fluid flow into and out of the chamber, wherein compression of the wall of the container forces the fluid from the chamber through the fluid passage, thereby absorbing energy.

5. The impact absorbing barrier system of claim 4, wherein at least one container of the plurality of containers is formed from polyethylene.

6. The impact absorbing barrier system of claim 4, wherein 25 to 75% of an interior volume of the barrier is filled with the fluid.

7. The impact absorbing barrier system of claim 4, wherein the fluid is selected from the group consisting of water and oil.

8. The impact absorbing barrier system of claim 4, wherein at least one container of the plurality of containers is cylindrical in shape, and wherein said plurality of containers are attached to a common base.

9. The impact absorbing barrier system of claim 4, wherein the barrier has a height of 2 to 5 feet and a diameter of 1 to 3 feet.

10. The impact absorbing barrier system of claim 4, wherein the baffle includes at least one fluid passage, and wherein the at least one fluid passage of the barrier is substantially aligned with the at least one fluid passage of the baffle.

11. The impact absorbing barrier system of claim 1, wherein a barrier of the plurality of impact absorbing barriers comprises:

a barrier wall defining a barrier chamber within the barrier wall; and a plurality of structures located within the barrier chamber, wherein the plurality of structures are configured to provide increased strength and stability to the barrier, and wherein the plurality of structures are configured to change an energy absorption behavior of the barrier to a desired energy absorption behavior upon an impact of the barrier.

12. The impact absorbing barrier of claim 11, wherein the plurality of structures are honeycomb shaped.

13. The impact absorbing barrier system of claim 12, wherein the plurality of honeycombed-shaped structures are hexagonal.

14. The impact absorbing barrier of claim 11, wherein the plurality of structures are truss supports.

15. The impact absorbing barrier system of claim 1, wherein the plurality of impact absorbing barriers are arranged in a line formation.

16. The impact absorbing barrier system of claim 1, wherein the plurality of impact absorbing barriers are arranged in a polygonal formation.

17. The impact absorbing barrier system of claim 1, wherein at least one of the barriers of the plurality of impact absorbing barriers has a different internal configuration than at least one other barrier of the plurality of impact absorbing barriers.

18. An impact absorbing barrier system, comprising:

a plurality of impact absorbing barriers including at least a first impact absorbing barrier and a second impact absorbing barrier; and at least one baffle positioned between the first impact absorbing barrier and the second impact absorbing barrier, wherein the baffle includes at least one fluid passage, the fluid passage permitting fluid flow through the baffle, wherein compression of the barrier system forces a fluid through the fluid passage, thereby absorbing energy.

* * * * *